US005114824A

United States Patent [19]

Tan et al.

[11] Patent Number: 5,114,824

[45] Date of Patent: May 19, 1992

[54] PROCESSES FOR ENCAPSULATED TONERS

[75] Inventors: Hock S. Tan, Burlington; Tie H. Ng; Hadi K. Mahabadi, both of Mississauga, all of Canada

[73] Assignee: Xerox Corporation, Stamford, Conn.

[21] Appl. No.: 592,092

[22] Filed: Oct. 1, 1990

[51] Int. Cl.[5] ..... G03G 9/093

[52] U.S. Cl. ..... 430/137; 430/138; 428/402.24

[58] Field of Search ..... 430/137, 138

[56] References Cited

U.S. PATENT DOCUMENTS

| | | | |
|---|---|---|---|
| 4,125,700 | 11/1978 | Graham | 430/281 X |
| 4,299,903 | 11/1981 | AuClair | 430/137 |
| 4,307,169 | 12/1981 | Matkan | 430/111 |
| 4,316,830 | 2/1982 | Mallow | 524/833 X |
| 4,407,922 | 10/1983 | Grushkin et al. | 430/98 |
| 4,465,755 | 8/1984 | Kiritani et al. | 430/111 |
| 4,610,945 | 9/1986 | Matsuoka et al. | 430/138 |
| 4,642,281 | 2/1987 | Kakimi et al. | 430/138 |
| 4,727,011 | 2/1988 | Mahabadi et al. | 430/138 |
| 4,758,506 | 7/1988 | Lok et al. | 430/903 |
| 4,937,167 | 6/1990 | Moffat et al. | 430/137 |
| 4,943,505 | 7/1990 | Aoki | 430/137 |

*Primary Examiner*—Roland Martin
*Attorney, Agent, or Firm*—E. O. Palazzo

[57] ABSTRACT

A process for the preparation of encapsulated toner which comprises (1) mixing a blend of a core monomer or monomers, free radical chemical initiator, pigment, and an oil soluble shell monomer to form an organic phase; (2) dispersing the resulting organic phase in the absence of surfactant or stabilizer in an aqueous solution comprised of a water-soluble shell monomer whereby interfacial shell polymerization is initiated; (3) stirring the resulting suspension to allow completion of interfacial shell polymerization; (4) initiating free radical core polymerization by increasing the temperature of the suspension from ambient to about 75° to about 90° C.; (5) completing core polymerization by maintaining the aforementioned temperature in step (4) for an effective period of time; (6) cooling; (7) filtering; and (8) drying.

36 Claims, No Drawings

PROCESSES FOR ENCAPSULATED TONERS

BACKGROUND OF THE INVENTION

The present invention is generally directed to processed for encapsulated toner compositions, and more specifically the present invention is directed to processes for the preparation of encapsulated toners by the interfacial polymerization of shell-forming monomers and the subsequent free radical polymerization of core monomer, or monomers wherein surfactants or stabilizers such as polyvinyl alcohol are avoided. Thus, in one embodiment of the present invention there are provided processes for the preparation of encapsulated toners by interfacial/free radical polymerization wherein encapsulated toner particles are formed in aqueous solution of a water soluble shell monomer, which solution excludes the undesirable surfactant or stabilizer normally used for such processes. A number of advantages are associated with the processes of the present invention in embodiments thereof such as the elimination of the need for surfactant and/or stabilizer, and avoiding processes for removing surfactant and/or stabilizer by washing the product during the post-reaction operations, especially washing with water to remove the surfactant and/or stabilizer; undesirable reaction of surfactant or stabilizer such as polyvinyl alcohol and other emulsifiers, like methylcellulose with shell monomers such as isocyanates during particle formation step is avoided thereby minimizing unpredictable particle size and suspension failure; the avoidance or minimization of the toner product to environmental humidity and electroconductivity instability since no surfactant or stabilizer is used and therefore no residual surfactant or stabilizer is present on the surface of the final toner; and cost reductions as no surfactant is selected. The elimination of the aforementioned toner washing step can enable substantial cost savings when preparing encapsulated toners. The electroconductivity instability problem when a surfactant or stabilizer is selected can result in the presence of residual surfactant or stabilizer on the toner surface, even after extensive washing in some instances, which residual surfactant or stabilizer can absorb moisture from the environment, causing undesirable changes in the electroconductivity of the toners. With the processes of the present invention, the aforementioned problem and other problems are avoided, or minimized since, for example, no surfactant or stabilizer is present and the electroconductivity stability can thus be maintained for extended time periods. The process of the present invention thus enables in embodiments thereof the generation of encapsulated toners with a controlled and stable resistivity, such as, for example, from about $1\times10^3$ to $1\times10^8$, and preferably from about $5\times10^4$ to $1\times10^7$ ohm-cm, which toners are particularly useful for inductive development processes. Also, for example, the toner compositions prepared in accordance with the process of the present invention can posses apparent bulk densities of from about 0.6 to 1.0 gram/cm$^3$.

The encapsulated toners obtained with the processes of the present invention can be selected for a number of imaging and printing systems, including xerographic and ionographic processes wherein, for example, cold pressure fixing is selected. The aforementioned toners prepared in accordance with the process of the present invention can thus be selected for permitting the development of images in reprographic imaging systems, inclusive of electrophotographic and ionographic imaging processes wherein pressure fixing, especially pressure fixing in the absence of heat, is selected. More specifically the encapsulated toner compositions obtained with the processes of the present invention can be selected for commercial ionographic printers, such as the Delphax S9000 S6000, S4500, S3000, and Xerox 4075 TM wherein, for example, transfixing is utilized, that is fixing of the developed image is accomplished by simultaneously transferring and fixing the developed images with pressure.

Encapsulated toners and processes for the preparation thereof are known. In a number of these processes, suspension and interfacial polymerization and interfacial/free radical polymerization methods are selected. In these known processes, there is selected the use of an aqueous phase containing surfactants or stabilizers primarily to aid the formation and stabilization of the toner particles and to prevent the coalescence of these particles. One known encapsulated toner process, disclosed in U.S. Pat. No. 4,727,011 involves the emulsification of a mixture of magnetic pigment, core monomer(s) and an oil soluble shell formation monomer in an aqueous phase containing a high molecular weight surfactant, such as polyvinyl alcohol, to stabilize the high density toner particles. This is followed by addition of a water soluble shell monomer to initiate the formation of a shell by interfacial polymerization, and subsequently, the core monomer(s) can be free radical polymerized by heating. Disadvantages associated with the aforementioned processes include the undesirable reaction of the polyvinyl alcohol with, for example, isocyanates present in the oil phase as one of the shell monomers; polyvinyl alcohol depletion can result in the loss of stabilizer efficiency, thus causing, for example, unpredictable particle size control, such as formation of undesirable particles of extremely large sizes, and suspension failure; the polyvinyl alcohol must be substantially removed by washing after polymerization of the core monomer, which washing can be time consuming and uneconomical; and some residual polyvinyl alcohol usually remains on the encapsulated toner surface product even after extensive washings, and this polyvinyl alcohol can absorb moisture and water which will adversely effect the electroconductivity of the encapsulated toner, and thus adversely effect the triboelectric characteristics thereof. Also, the absorbance of moisure usually causes the toner particles to agglomerate into large aggregates of, for example, from about 50 to about 200 microns, which can cause blocking problems in the development housing, or container in the machine systems selected for development. These and other disadvantages are avoided, or minimized with the processes of the present invention.

In copending application U.S. Pat. No. 5,045,422, D/89072, the disclosure of which is totally incorporated herein by reference, there are illustrated encapsulated toners which can be prepared by the interfacial polymerization of shell-forming monomers, followed by an in situ free radical polymerization of core binder-forming monomers. Thus, in one embodiment of the patent there is described a simple and economical method for the preparation of pressure fixable encapsulated toner compositions by interfacial/free radical polymerization methods wherein there are selected as core monomer(s) an addition type monomer or monomers, and an addition polymerizable fluorocarbon compound.

Other process embodiments disclosed in the patent relate to, for example, interfacial/free radical polymerization processes for obtaining encapsulated colored toner compositions. The aforementioned toners can be prepared by a interfacial/free radical polymerization process which comprises (1) mixing or blending of a core monomer or monomers, a functionalized fluorocarbon compound, free radical initiator, pigment, and a shell monomer or monomers; (2) dispersing the resulting mixture of materials by high shear blending into stabilized droplets in an aqueous medium with the assistance of suitable dispersants or emulsifying agents; (3) thereafter subjecting the aforementioned stabilized droplets of, for example, a specific droplet size and size distribution to a shell forming interfacial polycondensation; and (4) subsequently forming the core binder by heat induced free radical polymerization within the newly formed microcapsules. The shell forming interfacial polycondensation is generally accomplished at ambient temperature, however, elevated temperatures may also be employed depending on the nature and functionality of the shell monomers selected. For the core binder forming free radical polymerization, heating thereof is generally effected at a temperature of from ambient temperature to about 100° C., and preferably from ambient temperature to about 85° C. In addition, more than one initiator may be utilized to enhance the polymerization conversion, and to generate the desired core copolymer binder molecular weight and molecular weight distribution. Stabilizers, dispersants or emulsifying agents such as polyvinyl alcohol are utilized for the aforementioned processes. Further, in another process aspect of the patent the encapsulated toners can be prepared without organic solvents thus eliminating explosion hazards associated therewith, and, therefore, these processes do not require expensive and hazardous solvent separation and recovery steps. Moreover, with the aforementioned process of the patent there can be obtained in some instances improved throughput yield per unit volume of reactor size since, for example, the extraneous solvent component can be replaced by liquid core monomer(s) which would serve as a diluting vehicle and as a reaction medium.

There is disclosed in U.S. Pat. No. 4,307,169 microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there are disclosed in U.S. Pat. No. 4,407,922 pressure sensitive toner compositions comprised of a blend of two immiscible polymers selected from the group consisting of certain polymers as a hard component, and polyoctyldecylvinylether-co-maleic anhydride as a soft component. Interfacial polymerization processes can be selected for the preparation of the toners of this patent. Also, there are disclosed in the prior art encapsulated toner compositions containing costly pigments and dyes, reference, for example, the color photocapsule toners of U.S. Pat. Nos. 4,399,209; 4,482,624; 4,483,912 and 4,397,483. All these processes are believed to utilize an aqueous phase containing surfactant or stabilizer, such as polyvinyl alcohol, for preparation of encapsulated toners.

Moreover, illustrated in U.S. Pat. No. 4,758,506, the disclosure of which is totally incorporated herein by reference, are single component cold pressure fixable toner compositions, wherein the shell selected can be prepared by an interfacial polymerization process. A similar teaching is present in abandoned application U.S. Ser. No. 718,676, the disclosure of which is totally incorporated herein by reference. In the aforementioned abandoned application, the core can be comprised of magnetite and a polyisobutylene of a specific molecular weight encapsulated in a polymeric shell material generated by an interfacial polymerization. These processes involve the use of an aqueous phase containing surfactant or stabilizer, such as polyvinyl alcohol.

There is a need for processes for the preparation of encapsulated toner compositions wherein residual surfactant or residual stabilizer on the surface thereof is avoided. Also, there is a need for economical processes for the preparation of encapsulated toner compositions wherein the use of surfactants or stabilizers is avoided, thus enabling, for example, the elimination of process steps such as washing, and disposal of surfactant waste or stabilizer waste, and prevention of process failure such as suspension failure. There is also a need for a process for the preparation of encapsulated toner compositions which have stable triboelectrical properties, and stable blocking properties. There is also a need for a process for the preparation of encapsulated toner compositions wherein the generation of undesirable large sizes, for example greater than 40 micron particles, can be avoided if desired.

SUMMARY OF THE INVENTION

It is a feature of the present invention to provide processes for encapsulated toner compositions with many of the advantages illustrated herein.

In another feature of the present invention there are provided processes for encapsulated toner compositions comprised of a core comprised of polymer, or a plurality of polymers, pigments and/or dyes, and thereover a shell prepared, for example, by interfacial polymerization.

It is another feature of the present invention to provide processes for encapsulated toner composition processes wherein the use of surfactant or stabilizer, such as polyvinyl alcohol, is avoided.

Another feature of the present invention resides in the provision of economical processes for the preparation of encapsulated toners.

Another feature of the present invention resides in the provision of processes for the preparation of encapsulated toners with no residual surfactant or grafted stabilizer present after washing.

Another feature of the present invention resides in the provision of processes for the preparation of encapsulated toners with stable triboelectric charging characteristics, for example from about −30 to about 30 microcoulombs/gram as determined by the known Faraday Cage method.

In another feature of the present invention there are provided processes for the preparation of encapsulated toners with a particle size diameter of from about 5 to about 30 microns, and preferably from about 6 to about 20 microns.

In another feature of the present invention there are provided processes for the preparation of encapsulated toners with a substantially constant resistivity of from about $1\times10^3$ to about $1\times10^8$ and preferably from about $5\times10^4$ to about $1\times10^7$ ohm-cm.

Moreover, another feature of the present invention relates to processes for the preparation of encapsulated toners that are moisture resistant.

In another feature of the present invention, there are provided processes for the preparation of encapsulated toners that do not absorb water in embodiments thereof.

Also, in another feature of the present invention there are provided processes for the preparation of encapsulated toners that do not agglomerate during storage.

Also, in another feature of the present invention there are provided processes for the preparation of encapsulated toners wherein the bulk density is low, for example from about 0.6 to 1.0 gram/cm$^3$.

Another feature of the present invention in embodiments thereof resides in the provision of processes for encapsulated toners with desirable morphologies, low bulk densities, and free flowing characteristics when compared, for example, to a number of known encapsulated toners prepared by processes wherein surfactants are selected.

These and other features of the present invention can be accomplished by providing processes for encapsulated toner compositions. In one embodiment the present invention relates to surfactant free processes for the preparation of encapsulated toners. The process of the present invention in an embodiment comprises dispersing an organic phase mixture comprised of a core monomer, a free radical polymerization initiator, an oil soluble shell forming monomer, and a pigment, such as magnetite, in an aqueous solution of a water soluble shell formation monomer; polymerizing the surfaces of the resulting dispersed particles by interfacial polycondensation of the shell forming monomers; and polymerizing the core of the dispersed particles by free radical polymerization methods.

Examples of embodiments of the present invention include a process for the preparation of encapsulated toners which comprises (1) mixing a blend of a core monomer or monomers, free radical chemical initiator, pigment, and an oil soluble shell monomer; (2) dispersing the resulting mixture in the absence of surfactant or stabilizer in an aqueous solution containing a water-soluble shell monomer whereby interfacial shell polymerization is initiated; (3) stirring the resulting suspension to allow completion of interfacial shell polymerization; (4) initiating free radical core polymerization by increasing the temperature of the suspension from ambient to about 75° to about 90° C.; (5) completing core polymerization by maintaining the aforementioned temperature in step (4) for an effective period of time; (6) cooling; (7) filtering; and (8) drying; a surfactant free process for the preparation of encapsulated toners which comprises (1) mixing a blend of a core monomer, free radical chemical initiator, pigment, and an oil soluble shell monomer; (2) dispersing the resulting mixture in the absence of surfactant or stabilizer in an aqueous solution comprised of a water-soluble shell monomer whereby interfacial shell polymerization is initiated; (3) stirring the resulting suspension to allow completion of interfacial shell polymerization; (4) initiating free radical core polymerization by increasing the temperature of the suspension to about 75° to about 90° C.; (5) completing core polymerization by maintaining the aforementioned temperature in step (4) for an effective period of time; (6) cooling; (7) filtering; and (8) drying; and a surfactant free process for the preparation of encapsulated toners which comprises mixing a blend of a core monomer, free radical chemical initiator, magnetite, and an oil soluble shell monomer; (2) dispersing the resulting mixture in the absence of surfactant or stabilizer in an aqueous solution comprised of a water-soluble shell monomer whereby interfacial shell polymerization is initiated; (3) stirring the resulting suspension to allow completion of interfacial shell polymerization; (4) initiating free radical core polymerization by increasing the temperature of the suspension to about 75° to about 90° C.; (5) completing core polymerization by maintaining the aforementioned temperature in step (4) for an effective period of time; (6) cooling; (7) filtering; and (8) drying.

The present invention in an embodiment relates to the preparation of encapsulated toners which comprises (1) mixing a blend of a core monomer or monomers up to, for example, about 10 monomer, free radical chemical initiator, pigment, and an oil soluble shell monomer, for example from about 5 to about 20 weight percent; (2) dispersing the resulting mixture in an aqueous solution containing a water-soluble shell monomer whereby interfacial shell polymerization is initiated; (3) stirring the resulting suspension at, for example, ambient temperature to allow completion of interfacial shell polymerization; (4) initiating free radical core polymerization by increasing the temperature of the suspension from ambient to about 75° to about 90° C., and preferably to about 80° C.; (5) completing core polymerization by maintaining the aforementioned temperature in step (4) for an effective period of time of, for example, from about 4 to about 10 hours; (6) cooling; (7) filtering the toner; and (8) drying the toner. Mixing the blend can be accomplished by a number of methods including the utilization of a high shear rotar-stator homogenizer at effective mixing times of, for example, from about 1 to about 10, and preferably from about 1 to about 3 minutes at various speeds, for example from about 3,000 to about 8,000 revolutions per minute (RPM). The aqueous solution can contain from about 75 to about 99 weight percent of water, and from about 1 to about 25 weight percent of shell monomer for example. Effective amounts of oil soluble shell monomer, for example from about 5 to about 20 weight percent can be selected. From for example, about 5 to about 40, and preferably from about 10 to about 30 weight percent of the blend can be selected. Dispersion can be accomplished by, for example, a high shear rotor-stator at various effective speeds, for example from about 8,000 to about 20,000 revolutions per minute (RPM). Step (3) stirring can be accomplished by a number of known processes including mechanical stirring at speeds of, for example, from about 300 to about 500 RPM, and at a temperature of from, for example, about 20° to about 30° C. Cooling can be affected by termination of heating, and allowing the product to remain at room temperature at, for example, for about 10 to about 16 hours. After cooling, filtration by, for example, suction filtration, and the like can be accomplished to enable the solid toner product. The filtered wet toner particles are dried using, for example, spray drying. Additionally, in accordance with the process of the present invention there can be added to the resulting toner composition from about 0.2 to 2 weight percent, preferably from about 0.1 to about 1 weight percent, of a flow agent, such as zinc stearate and Aerosil. Also, there can be added to the toner composition obtained from about 0.1 to about 8, preferably from about 1 to about 6.5 weight percent, of a conductive component such as conductive graphite Aquadag E and known carbon blacks available, for example, from Cabot Corporation.

In embodiments of the present invention, from about 10 to about 99.5, and preferably from about 15 to about 50 weight percent of core monomer is selected; from about 0.1 to about 5 weight percent of initiator is utilized; and from about 2 to about 75, and preferably from about 5 to about 65 weight percent of known pigments, including magnetite, such as Pfizer BK5399, MO8029, and/or carbon black, such as Regal 330® carbon black, are selected.

Examples of core monomers selected present in effective amounts of, for example, from about 10 to about 99.5 weight percent that are subsequently polymerized include, but are not limited to, addition type monomers such as acrylates, styrenes, and methacrylates. Specific core monomer examples are propyl acrylate, propyl methacrylate, butyl acrylate, butyl methacrylate, pentyl acrylate, pentyl methacrylate, hexyl acrylate, hexyl methacrylate, cyclohexyl acrylate, cyclohexyl methacrylate, lauryl acrylate, lauryl methacrylate, stearyl acrylate, stearyl methacrylate, benzyl acrylate, benzyl methacrylate, ethoxypropyl acrylate, ethoxypropyl methacrylate, heptyl acrylate, heptyl methacrylate, isobutyl acrylate, isobutyl methacrylate, methylbutyl acrylate, methylbutyl methacrylate, tolyl acrylate, tolyl methacrylate, styrene, dodecyl styrene, hexyl methyl styrene, nonyl styrene, tetradecyl styrene, or other substantially equivalent addition monomers; other known vinyl monomers, reference for example U.S. Pat. No. 4,298,672, the disclosure of which is totally incorporated herein by reference; and the like.

Various known colorants or pigments present in the core in an effective amount of, for example, from about 2 to about 75 percent by weight of toner, and preferably in an amount of from about 5 to about 65 percent by weight can be selected inclusive of carbon black, such as those available from Cabot Corporation; magnetites, such as Mobay magnetites; Columbian magnetites, Mapico Blacks and surface treated magnetites; Pfizer magnetites BK5399, MO8029, CB4799, CB5300, CB5600, MCX6369; Bayer magnetites Bayferrox 8600, 8610; Northern Pigments magnetites NP-604, NP-608; Magnox magnetites TMB-100 or TMB-104; and other equivalent black pigments. As colored pigments there can be selected red, blue, brown, green, Heliogen Blue L6900, D6840, D7080, D7020, Pylam Oil Blue and Pylam Oil Yellow, Pigment Blue 1 available from Paul Uhlich & Company, Inc., Pigment Violet 1, Pigment Red 48, Lemon Chrome Yellow DCC 1026, E.D. Toluidine Red and Bon Red C available from Dominion Color Corporation, Ltd., Toronto, Ontario, NOVAperm Yellow FGL, Hostaperm Pink E from Hoechst, Cinquasia Magenta available from E.I. DuPont de Nemours & Company, and the like. Generally, colored pigments that can be selected include cyan, magenta, or yellow pigments, and mixtures thereof. Examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-(octadecyl sulfonamido) phthalocyanine, x-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the microencapsulated toner compositions in various suitable effective amounts. In one embodiment, these colored pigment particles are present in the toner composition in an amount of from about 2 percent by weight to about 65 percent by weight calculated on the weight of the dry toner. Colored magnetites, such as mixtures of Mapico Black, and cyan components may also be used as pigments for the toners of the present invention.

Examples of shell polymers include polyureas, polyamides, polyesters, polyurethanes, mixtures thereof, and polycondensation products of polyisocyanates and polyamines as illustrated in U.S. Pat. No. 4,877,707, entitled Single Component Cold Pressure Fixable Encapsulated Toner Compositions, the disclosure of which is totally incorporated herein by reference, and the like. The shell is generally present in various effective amounts of, for example, from about 5 to about 25 percent by weight of the toner, and can have a thickness generally, for example, of less than about 5 microns, and more specifically from about 0.1 micron to about 3 microns. Other shell polymers, shell amounts, and thicknesses may be selected.

Examples of the shell forming monomer components present in the organic phase include diisocyanates, diacyl chloride, bischloroformate, together with appropriate polyfunctional crosslinking agents such as triisocyanate, triacyl chloride and other polyisocyanates. Specific illustrative examples of the shell monomer components include benzene diisocyanate, toluene diisocyanate, diphenylmethane diisocyanate, cyclohexane diisocyanate, hexane diisocyanate, adipoyl chloride, fumaryl chloride, suberoyl chloride, succinyl chloride, phthaloyl chloride, isophthaloyl chloride, terephthaloyl chloride, ethylene glycol bischloroformate, diethylene glycol bischloroformate, and the like. The water-soluble, shell forming monomer components in the aqueous phase can be a polyamine or a polyol including bisphenols. Illustrative examples of water soluble shell monomers include known monomers such as ethylenediamine, triethylenediamine, diaminotoluene, diaminopyridine, bis(aminopropyl)piperazine, bisphenol A, bisphenol Z, and the like. When desired, an effective amount, for example from about 1 to about 10 percent by weight, of a water soluble crosslinking agent, such as triamine or triol, can also be added primarily to improve the mechanical strength of the polymeric shell structure. Shell polymer examples are illustrated in U.S. Pat. No. 4,877,706, the disclosure of which is totally incorporated herein by reference. Also, other known shells may be selected.

Illustrative examples of free radical initiators selected for the preparation of the toners of the present invention include azo compounds such as 2-2'-azodimethylvaleronitrile, 2-2'-azoisobutyronitrile, azobiscyclohexanenitrile, 2-methylbutyronitrile, mixtures thereof, and the like, with the quantity of initiator(s) being, for example, from about 0.5 percent to about 10 percent by weight of that of core monomer(s). Other known initiators may be selected.

Interfacial polymerization processes selected for the shell formation of the toners of the present invention are as illustrated, for example, in U.S. Pat. Nos. 4,000,087 and 4,307,169, the disclosures of which are totally incorporated herein by reference.

Surface additives can be added to the encapsulated toners of the present invention by, for example, known mixing methods, including, for example, metal salts, metal salts of fatty acids, such as zinc stearate, colloidal silicas, such as Aerosil, mixtures thereof, and the like, which additives are usually present in an amount of from about 0.1 to about 1 weight percent, reference U.S. Pat. Nos. 3,590,000; 3,720,617; 3,655,374 and 3,983,045, the disclosures of which are totally incorporated herein by reference. Preferred additives include zinc stearate and Aerosil.

Also, the toner compositions of the present invention can be rendered relatively conductive with, for example, a volume resistivity of from about $5\times10^3$ ohm-cm to about $5\times10^8$ ohm-cm by adding with mixing to the surface thereof components, such as carbon blacks, such as those available from Cabot Corporation, including Black Pearls, and the like; graphite, and other conductive materials in an effective amount of from, for example, about 0.1 percent to about 8 percent by weight of the toner product, and preferably from about 1 percent to about 6.5 percent by weight of toner. The conductive toner surface enables the use of inductive development systems such as those present in the commercial Delphax printers.

For two component developers, carrier particles including steel, iron, ferrites, copper zinc ferrites, and the like, with or without coatings, can be admixed with the encapsulated toners of the present invention, reference, for example, the carriers illustrated in U.S. Pat. Nos. 4,937,166, 4,935,326; 4,560,635; 4,298,672; 3,839,029; 3,847,604; 3,849,182; 3,914,181; 3,929,657 and 4,042,518, the disclosures of which are totally incorporated herein by reference.

The following examples, are being submitted to further define various species of the present invention. These examples are intended to be illustrative only and are not intended to limit the scope of the present invention. Also, parts and percentages are by weight unless otherwise indicated. Also, comparative examples are presented.

Unless otherwise noted, the cold pressure fix printing machine selected for the testing of the toner compositions illustrated herein, including the following working Examples, was the Delphax S6000 ionographic apparatus. The images developed were cold pressure fixed at 200 pounds per linear inch. Print quality was evaluated from a checkerboard print pattern. Fix level was measured from a standardized tape test in which scotch tape was pressed with a uniform reproducible standard pressure against an image and then removed. The fix level of the print was determined by measuring the reflected optical density(OD) after removal of the tape, and dividing this by the reflected OD of the original image. Conversion of percentage is accomplished by multiplying the aforesaid resulting value by 100. The percentage fix, therefore, can be defined as the percentage of the orginal optical density remaining after the tape has been applied and subsequently removed. The initial and final fix levels represent the tape test of a print measured at 1 minute and 24 hours, respectively. Toner shell integrity was judged qualitatively by observing any crushed or agglomerated toner on the hopper screen through which toner was fed to the machine magnetic rollers. If crushed toner was found to adhere to and clog some of the screen openings after 2,000 copies, it was judged to have a premature toner rupture problem. The electrical resistivity was measured by applying 10 volts DC across a 1 cubic centimeter volume of toner and measuring the current. The electroconductivity activity of the toner was considered stable if the resistivity did not change by more than ten times under conditions equivalent to machine agitation for one hour. Particle size and GSD were measured using a 14 channel Coulter Counter (Model TA II, Coulter Electronics, Inc.).

EXAMPLE I

An organic phase mixture was prepared by mixing homogeneously 82.0 grams of n-laurylmethacrylate (Rocryl 320, Rohm and Haas Company), 1.45 grams of 2,2'-azobisisobutyronitrile (Vazo 64, E. I. duPont de Nemours & Company, Inc.), 32.3 grams of toluene diisocyanate (TDI-80, Olin Chemical), 14.6 grams of Desmodur RF (20 percent crosslinker in dichloromethane, Bayer) and 212.0 grams of magnetite iron oxide (BK5399, commercially available from Pfizer Pigments Inc.) in a two liter vessel equipped with a high shear rotor-stator type mixer (Model PT45/6G, Brinkmann) operating at about 5,000 to 6,000 revolutions per minute (RPM) for 2 to 3 minutes. This organic phase mixture was dispersed in an aqueous solution containing 4.3 grams of diethylenetriamine (99 percent grade, commercially available from Dow Chemical Company) and 1,050 grams of deionized water using the above high shear mixer at about 15,000 RPM for 3 minutes. There was obtained an oil-in-water suspension containing pigmented oily spherical particles with an average particle diameter of about 18 microns.

The resulting suspension was transferred to a reactor equipped with a microcomputer controlled heating system. The reaction mixture in the reactor was agitated with a mechanical stirrer under low stirring speed (about 300 RPM) and maintained at ambient temperature for 30 minutes to allow the completion of the polyurea formation on the surfaces of the particles by interfacial polycondensation. Subsequently, the temperature of the reaction mixture was increased at a rate of 1° C./minute to 85° C. and remained constant at 85° C. for another 3.5 hours to enable free radical polymerization of the core monomer, n-laurylmethacrylate.

After completion of core polymerization, the reaction slurry was cooled to 25° C. and filtered through a 150 micron sieve to remove large agglomerates. The pH of the filtrate was measured and found to be between 7 and 8, which indicates that most of the diethylenetriamine was reacted and thus no washing of the toner product is necessary to remove the unreacted diethylenetriamine. After sieving, 19.8 grams of conductive graphite, Aquadag E (obtained from Acheson Colloids), which contains about 22 percent of graphite and 2 percent of polymeric binder, was added to a encapsulated toner slurry comprised of the above prepared encapsulated toner precipitate, 400 grams, and 500 grams of water. This mixture was then subjected to spray drying with a Yamamoto DL-41 spray dryer at air inlet temperature of 160° C., and an air exit temperature of 65° C., and an atomizing pressure of 1.2 killigrams/cm$^2$.

The above dried encapsulated toner was then dry blended with 1.3 grams of carbon black (Black Pearls 2000) and 3.6 grams of zinc stearate (release agent). The dry blended toner was screened through a 63 micron sieve to remove agglomerated additives; the toner volume means diameter was 17.0 microns with a geometric standard deviation (gsd) of 1.34, both determined by a Coulter Counter. The toner was observed by a Scanning Electron Microscope and found to be composed of mainly irregular shapes.

The tape test for image fix, for the above prepared encapsulated toner, showed an initial fix level of about 20 percent, a final fix level of 43 percent, and an optical density of 1.51. There was no ghosting and offset/-smearing and no toner agglomeration at the development housing or container of the Delphax S6000.

The toner obtained evidenced a very stable and uniform electrical resistivity of $1.1\times10^6$ ohm-cm for 20,000 prints. Other properties for this encapsulated toner include a bulk density of 0.6 gram/cm$^3$ determined by an Englesman Tap-Pak Volumeter, and magnetic saturation of 56.0 emu/gram determined with an EMU meter.

EXAMPLE II

This example demonstrates the presence of diethylenetriamine in the aqueous phase during the high shear dispersion. An encapsulated toner composition was prepared by repeating the procedure of Example I with the exception that diethylenetriamine was not present in the aqueous solution during the high shear dispersion step. The high density organic phase failed to disperse in the aqueous phase and suspension failure occurred instantly.

EXAMPLES III, IV, V AND VI

Four toner compositions were prepared to primarily illustrate the effects of the homogenizer speed during the high shear dispersion on the particle size of the toner. These encapsulated toners were prepared by repeating the procedure of Example I with the exception that the homogenizer speeds were 10,000, 13,200, 16,500 and 19,000 RPM, respectively, for Examples III, IV, V and VI. Toner particles with different volume mean diameters were obtained as illustrated in Table 1.

TABLE 1

| EXAMPLE | Speed (RPM) | Mean Diameter (μm) |
|---|---|---|
| Example III | 10,000 | 31.6 |
| Example IV | 13,200 | 26.1 |
| Example V | 16,500 | 21.0 |
| Example VI | 19,000 | 20.0 |

EXAMPLES VII, VIII, IX AND X

Four toner compositions were prepared to primarily illustrate the effects of the amount or fraction of organic phase in the suspension during the high shear dispersion on the particle size of the toner. These encapsulated toners were prepared by repeating the procedure of Example I with the exception that the weight of each component was adjusted accordingly to provide the percentage of organic phase in the suspension of 9.8, 19.7, 24.2 and 32.1, respectively, for Examples VII, VIII, IX and X. Toner particles with different volume mean diameters were obtained as illustrated in Table 2.

TABLE 2

| EXAMPLE | Organic Phase (Percent) | Mean Diameter (μm) |
|---|---|---|
| Example VII | 9.8 | 17.0 |
| Example VIII | 19.7 | 18.6 |
| Example IX | 24.2 | 20.0 |
| Example X | 32.1 | 22.6 |

EXAMPLE XI

An encapsulated toner composition was prepared by repeating the procedure of Example I with the exception that the magnetic iron oxide Pfizer BK5399 was replaced with Pfizer MO8029 magnetite.

The toner volume mean diameter was 18.2 microns with a geometric standard deviation (gsd) of 1.36. The tape test for image fix quality showed an initial fix level of about 21 percent, a final fix level of 53 percent, and an optical density of 1.61. There was no ghosting and offset/smearing, and no toner agglomeration at the development housing or container. The toner obtained evidenced a very stable and uniform electrical resistivity of $7.1\times10^5$ ohm-cm for 20,000 prints in the Delphax S6000.

Other modifications of the present invention may occur to those skilled in the art subsequent to a review of the present application, and these modifications are intended to be included within the scope of the present invention.

What is claimed is:

1. A process for the preparation of encapsulated toners which consists essentially of (1) mixing a blend of a core monomer or monomers, free radical chemical initiator, pigment, and an oil soluble shell monomer to form an organic phase; (2) dispersing the resulting organic phase in the absence of surfactant or stabilizer in an aqueous solution comprised of a water-soluble shell monomer whereby interfacial shell polymerization is initiated; (3) stirring the resulting suspension to allow completion of interfacial shell polymerization; (4) initiating free radical core polymerization by increasing the temperature of the suspension from ambient to about 75 to about 90° C.; (5) completing core polymerization by maintaining the aforementioned temperature in step (4) for an effective period of time; (6) cooling; (7) filtering; and (8) drying.

2. A surfactant free process for the preparation of encapsulated toners which consists essentially of (1) mixing a blend of a core monomer, free radical chemical initiator, pigment, and an oil soluble shell monomer to form an organic phase; (2) dispersing the resulting organic phase in the absence of surfactant or stabilizer in an aqueous solution comprised of a water-soluble shell monomer whereby interfacial shell polymerization is initiated; (3) stirring the resulting suspension to allow completion of interfacial shell polymerization; (4) initiating free radical core polymerization by increasing the temperature of the suspension to about 75 to about 90° C.; (5) completing core polymerization by maintaining the aforementioned temperature in step (4) for an effective period of time; (6) cooling; (7); filtering; and (8) drying.

3. A surfactant free process for the preparation of encapsulated toners which consists essentially of (1) mixing a blend of a core monomer or monomers, free radical chemical initiator, magnetite, and an oil soluble shell monomer to form an organic phase; (2) dispersing the resulting organic phase in the absence of surfactant or stabilizer in an aqueous solution comprised of a water-soluble shell monomer whereby interfacial shell polymerization is initiated; (3) stirring the resulting suspension to allow completion of interfacial shell polymerization; (4) initiating free radical core polymerization by increasing the temperature of the suspension to about 75° to about 90° C.; (5) completing core polymerization by maintaining the aforementioned temperature in step (4) for an effective period of time; (6) cooling; (7) filtering; and (8) drying.

4. A process in accordance with claim 1 wherein the surface of encapsulated toner compositions produced is free from residual surfactant or stabilizer.

5. A process in accordance with claim 1 wherein the aqueous phase is comprised of water and a water soluble shell formation monomer.

6. A process in accordance with claim 1 wherein the organic phase is dispersed in the aqueous phase in the absence of surfactant or stabilizer to produce particles with a mean particle size of about 5 to about 30 microns using a high shear rotor-stator homogenizer.

7. A process in accordance with claim 1 wherein washing of the toner product is avoided.

8. A process in accordance with claim 1 wherein the interfacial polycondensation of the shell monomers is accomplished at a temperature of from about 20° to about 40° C., and the free radical polymerization of the core monomer is accomplished by heating to a temperature between about 75° to about 95° C.

9. A process in accordance with claim 1 wherein the organic phase is comprised of a core monomer or monomers, an initiator, an oil soluble shell monomer such as an isocyanate and a pigment; and the aqueous phase is comprised of a water soluble monomer.

10. A process in accordance with claim 1 wherein the toner composition comprises from about 10 to about 70 percent by weight of core monomer(s), from about 5 to about 30 percent by weight of shell monomer(s) and from about 10 to about 75 percent by weight of pigment, and the resulting toner has mean particle size of from about 5 to about 30 microns, a bulk density of 0.6 to 1.0 gram/cm$^3$ and a resistivity of from about $1\times10^3$ to about $1\times10^8$ ohm-cm, preferably from about $5\times10^4$ to about $1\times10^7$ ohm-cm.

11. A process in accordance with claim 1 wherein the core monomer is an acrylate, a methacrylate, or styrene.

12. A process in accordance with claim 1 wherein the pigment is cyan, yellow, magenta, red, green, blue, brown, or mixtures thereof.

13. A process in accordance with claim 1 wherein the pigment is magnetite.

14. A process in accordance with claim 13 wherein the magnetite is Mapico Black.

15. A process in accordance with claim 1 wherein the pigment is carbon black.

16. A process in accordance with claim 1 wherein the shell is prepared by interfacial polymerization.

17. A process in accordance with claim 1 wherein the shell is a polyurea, a polyamide, a polyurethane, a polyester, or mixtures thereof.

18. A process in accordance with claim 2 wherein the toner contains surface additives.

19. A process in accordance with claim 18 wherein the surface additives are comprised of conductive components, release additives, or mixtures thereof.

20. A process in accordance with claim 19 wherein the conductive additives are colloidal graphite, carbon black, or mixtures thereof.

21. A process in accordance with claim 19 wherein the release additive is zinc stearate.

22. A process in accordance with claim 1 wherein the pigment is a magnetite which is acicular and is present in an amount of from about 15 to about 75 percent by weight.

23. A process in accordance with claim 2 wherein the magnetite is cubic and is present in an amount of from about 40 to about 75 percent by weight.

24. A process in accordance with claim 1 wherein the mean particle diameter thereof is from about 5 to about 30 microns.

25. A process in accordance with claim 1 wherein the mean particle diameter thereof is from about 16 to about 28 microns.

26. A process in accordance with claim 1 wherein the mean particle diameter thereof is from about 18 to about 25 microns.

27. A process in accordance with claim 2 wherein the mean particle diameter thereof is from about 16 to about 28 microns.

28. A process in accordance with claim 3 wherein the mean particle diameter thereof is from about 16 to about 28 microns.

29. A process in accordance with claim 4 wherein the mean particle diameter thereof is from about 16 to about 28 microns.

30. A process in accordance with claim 9 wherein the organic phase core monomer is an alkyl acrylate, an alkyl methacrylate, styrene or styrene derivatives; the initiator is 2,2'-azodimethylvaleronitrile, or 2,2'-azoisobutyronitrile; the oil soluble shell monomer is an isocyanate; and the aqueous phase is comprised of a water-soluble amine monomer and deionized water.

31. A process for the preparation of encapsulated toners which consists essentially of (1) mixing a blend of a core monomer or monomers, free radical initiator, pigment, and an oil soluble shell monomer; (2) dispersing the resulting mixture in the absence of surfactant or stabilizer in an aqueous solution comprised of a water-soluble shell monomer whereby interfacial shell polymerization is initiated; (3) initiating free radical core polymerization; and (4) completing core polymerization.

32. A process in accordance with claim 31 wherein subsequent to completing core polymerization, the resulting product is cooled, filtered, and dried.

33. A surfactant free process for the preparation of encapsulated toners which consists essentially of (1) mixing a blend of a core monomer or monomers, free radical chemical initiator, pigment, and an oil soluble shell monomer; (2) dispersing the resulting mixture in the absence of surfactant or stabilizer in an aqueous solution comprised of a water-soluble shell monomer whereby interfacial shell polymerization is initiated; (3) initiating free radical core polymerization by increasing the temperature of the suspension to about 75° to about 90° C.; and (4) completing core polymerization by maintaining the aforementioned temperature in step (3) for an effective period of time.

34. A process in accordance with claim 33 wherein subsequent to completing core polymerization, the resulting product is cooled, filtered, and dried.

35. A process in accordance with claim 2 wherein the interfacial polycondensation of the shell monomers is accomplished at a temperature of from between about 20° to about 40° C., and the free radical polymerization of the core monomer is accomplished by heating to a temperature between about 75° to about 95° C.

36. A process in accordance with claim 3 wherein the interfacial polycondensation of the shell monomers is accomplished at a temperature of from between about 20° to about 40° C., and the free radical polymerization of the core monomer is accomplished by heating to a temperature between about 75° to about 95° C.

* * * * *